US011214412B2

(12) United States Patent
Cohan et al.

(10) Patent No.: US 11,214,412 B2
(45) Date of Patent: Jan. 4, 2022

(54) DRINK PROTECTOR

(71) Applicants: Andrew Cohan, Los Angeles, CA (US); Jessica Thomas, Los Angeles, CA (US)

(72) Inventors: Andrew Cohan, Los Angeles, CA (US); Jessica Thomas, Los Angeles, CA (US)

( * ) Notice: Subject to any disclaimer, the term of this patent is extended or adjusted under 35 U.S.C. 154(b) by 36 days.

(21) Appl. No.: 16/721,880

(22) Filed: Dec. 19, 2019

(65) Prior Publication Data

US 2021/0188497 A1 Jun. 24, 2021

(51) Int. Cl.
*B65D 47/06* (2006.01)

(52) U.S. Cl.
CPC .... *B65D 47/06* (2013.01); *B65D 2543/00046* (2013.01); *B65D 2543/00092* (2013.01); *B65D 2543/00296* (2013.01)

(58) Field of Classification Search
CPC ..... B65D 47/06; B65D 47/26; B65D 47/04; B65D 47/043; B65D 47/046; B65D 47/065; B65D 2543/00046; B65D 2543/00092; B65D 2543/000296
USPC ..... 220/711
See application file for complete search history.

(56) References Cited

U.S. PATENT DOCUMENTS

| | | | | |
|---|---|---|---|---|
| 10,940,980 | B1 * | 3/2021 | Schaefer | B65D 43/0212 |
| 2007/0039960 | A1 * | 2/2007 | Pawlik | B65D 51/18 220/254.7 |
| 2008/0105696 | A1 * | 5/2008 | Dart | B65D 43/0212 220/711 |
| 2014/0057023 | A1 * | 2/2014 | Sabga | B65D 47/06 426/77 |

* cited by examiner

*Primary Examiner* — Steven A. Reynolds
*Assistant Examiner* — Javier A Pagan
(74) *Attorney, Agent, or Firm* — Savantek Patent Services; Ivan E. Rozek

(57) ABSTRACT

A drink protector lid capable of being snapped onto a standard disposable cup in a standard way. A slidable aperture cover includes an extension tab that can be snapped onto a post in the center of the lid. The lid includes a centrally disposed depressed portion allowing space for a user's nose during use. The lid also includes a portion having widened top surface that has a plurality of small holes for allowing a beverage to pass through but restricting the introduction of foreign matter such as a mind-altering drug pill, powder or liquid. The widened top surface also has a raised portion on one side creating a stop for the slidable aperture cover.

1 Claim, 4 Drawing Sheets

DRINK PROTECTOR

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of lids for disposable drinking cups and more specifically to drink protector lid.

Disposable cups and lids are well known. They are used by restaurants, bars and concert venues and also sold to individuals to hold various types of beverages. When a person removes the lid, the beverage is exposed to the possibility of someone inserting a pill or powder into the cup which may cause the drinker to become drowsy or have other symptoms that might let a person take advantage of the drinker.

Although many lids have been designed and manufactured for the purpose of sealing the top of a disposable cup, most of them require the user to remove the lid for drinking purposes. Some lids have apertures in them so that the user can drink the contents in the cup without removing the lid.

However, none of the current disposable lids presently available has the ability for the user to slide a secondary cover away from the drinking aperture and then slide it back again when not drinking. Additionally, none of the current disposable lids has an aperture that is made of a plurality of small holes that make it difficult for another person to deposit a pill or powder into the aperture. Finally, none of the current disposable lids has a slidable cover that can be slid away from the aperture and then slid back over the aperture without the user needing to visually see that movement to know that the secondary cover is properly opened or closed.

BRIEF SUMMARY OF THE INVENTION

The primary object of the invention is to provide a disposable drink protector lid that helps prevent unwanted tampering of a beverage.

Another object of the invention is to provide a disposable drink protector lid that allows the user to quickly and easily slide a secondary protective cover, which covers the drinking aperture from an open position to a closed position without removing the primary lid from the beverage cup.

Another object of the invention is to provide a disposable drink protector lid whose exit aperture is made of a plurality of small holes rather than one large hole to help prevent the insertion of unwanted material into the beverage cup.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a drink protector comprising: a thermo-formed plastic circular lid capable of being snapped onto a standard disposable cup in a standard way, a slidable aperture cover, said slidable aperture cover having an extension tab, said extension tab having a circular die cut portion, said thermo-formed circular lid including an aperture for allowing a beverage to be drunk without removing said vacuum formed circular lid said disposable cup, said thermo-formed circular lid including a centrally and upwardly disposed mushroom shaped post capable of receiving said circular die cut portion of said extension tab allowing said slidable aperture cover to rotate, said thermo-formed circular lid including a centrally disposed depressed portion allowing space for a user's nose during use, said thermo-formed circular lid also including a portion having widened top surface, said widened top surface including said aperture for allowing said beverage to be drunk, said aperture of said widened top surface being comprised of a plurality of small holes for allowing a beverage to pass through but not allowing foreign matter such as a mind altering drug pill or powder to be easily inserted, and said widened top surface also having a raised portion on one side creating a stop for said slidable aperture cover.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
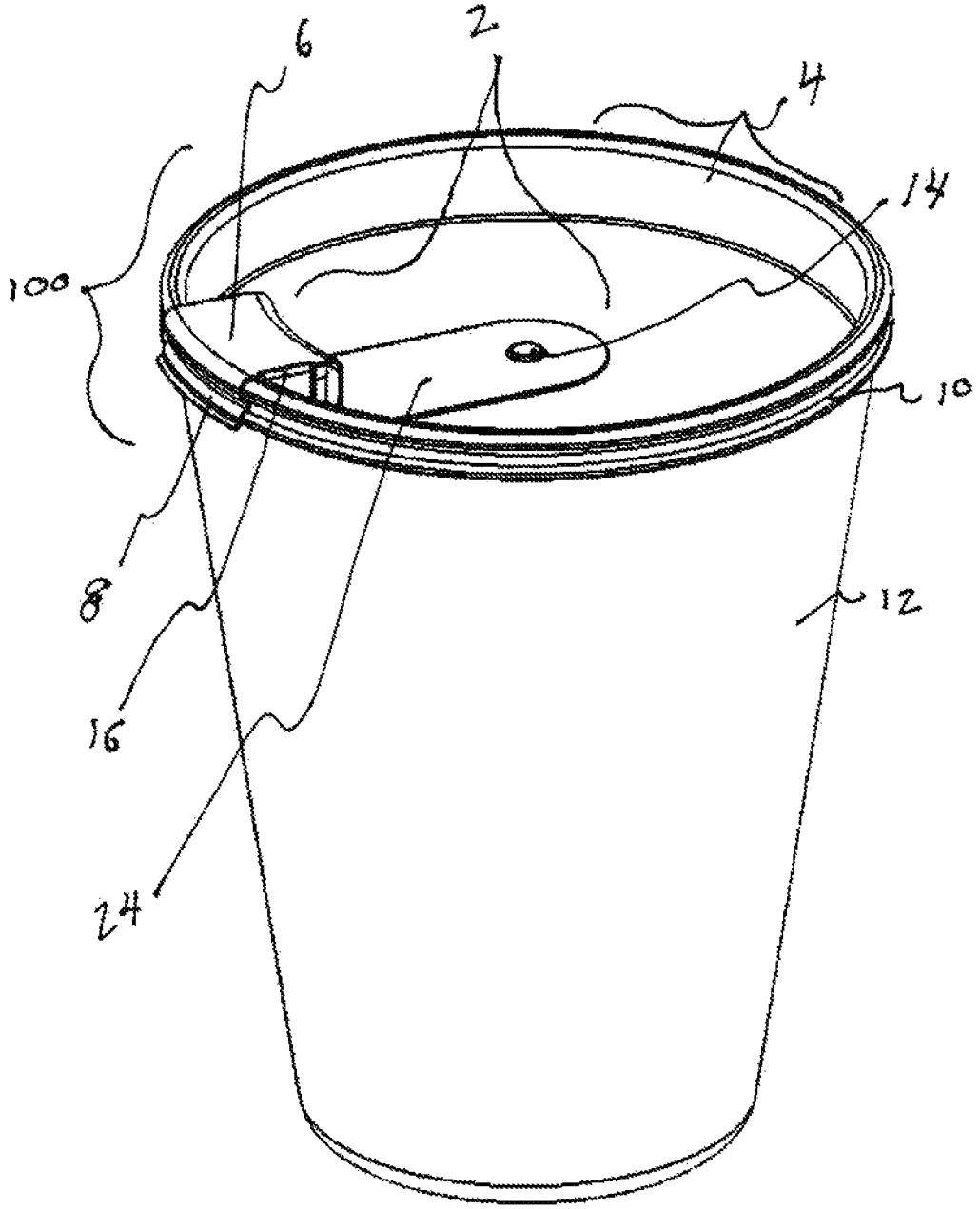
FIG. 1 is a perspective view of the invention with the aperture closure member in place.
Figure 4:
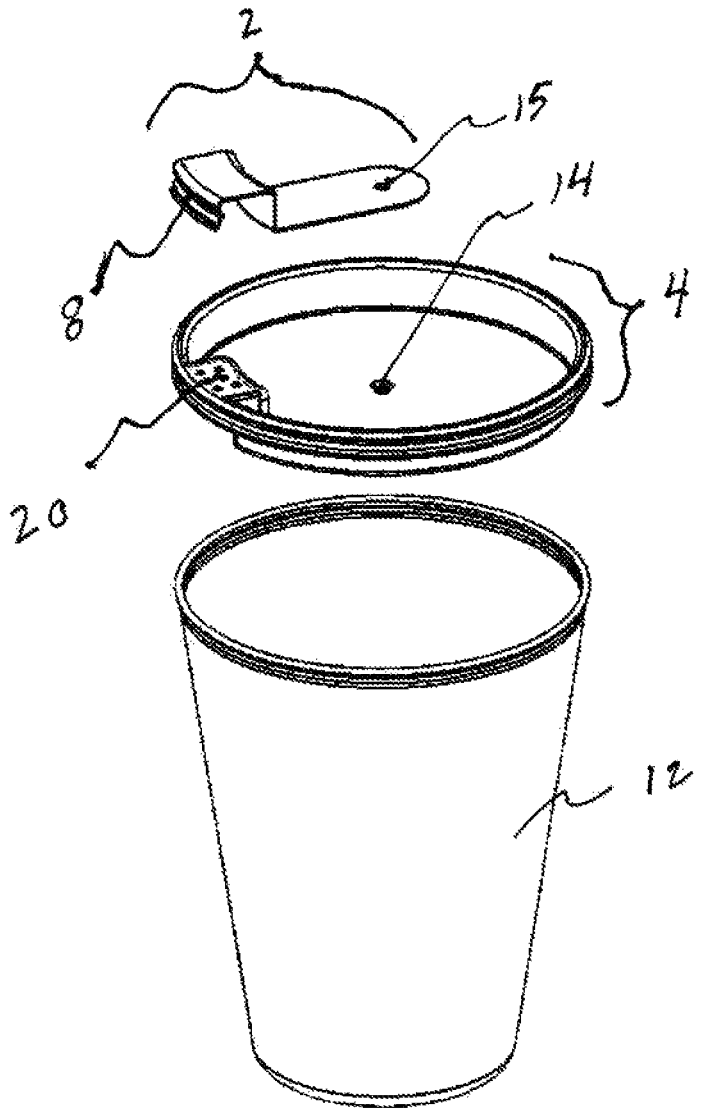
FIG. 4 is an exploded view of the invention.

Referring now to FIG. 1 we see a perspective view of a circular thermo-formed lid 4 of the present invention removably attached to a standard disposable drinking cup 12. An aperture cover 2 is a separate thermo-formed part that includes an extension tab 24 that has an aperture allowing the tab 24 to be rotatably attached to a centrally and upwardly extending post 14 at the center of the lid 4. The post 14 includes a widened, or mushroom shaped portion at the top. The tab aperture 15, shown in FIG. 4, is slightly smaller than the mushroom top of the post 14 so that when it is forcibly pressed over the mushroom shaped top, the tab 24 is rotatable but cannot be easily removed from the lid 4.

Figure 3:
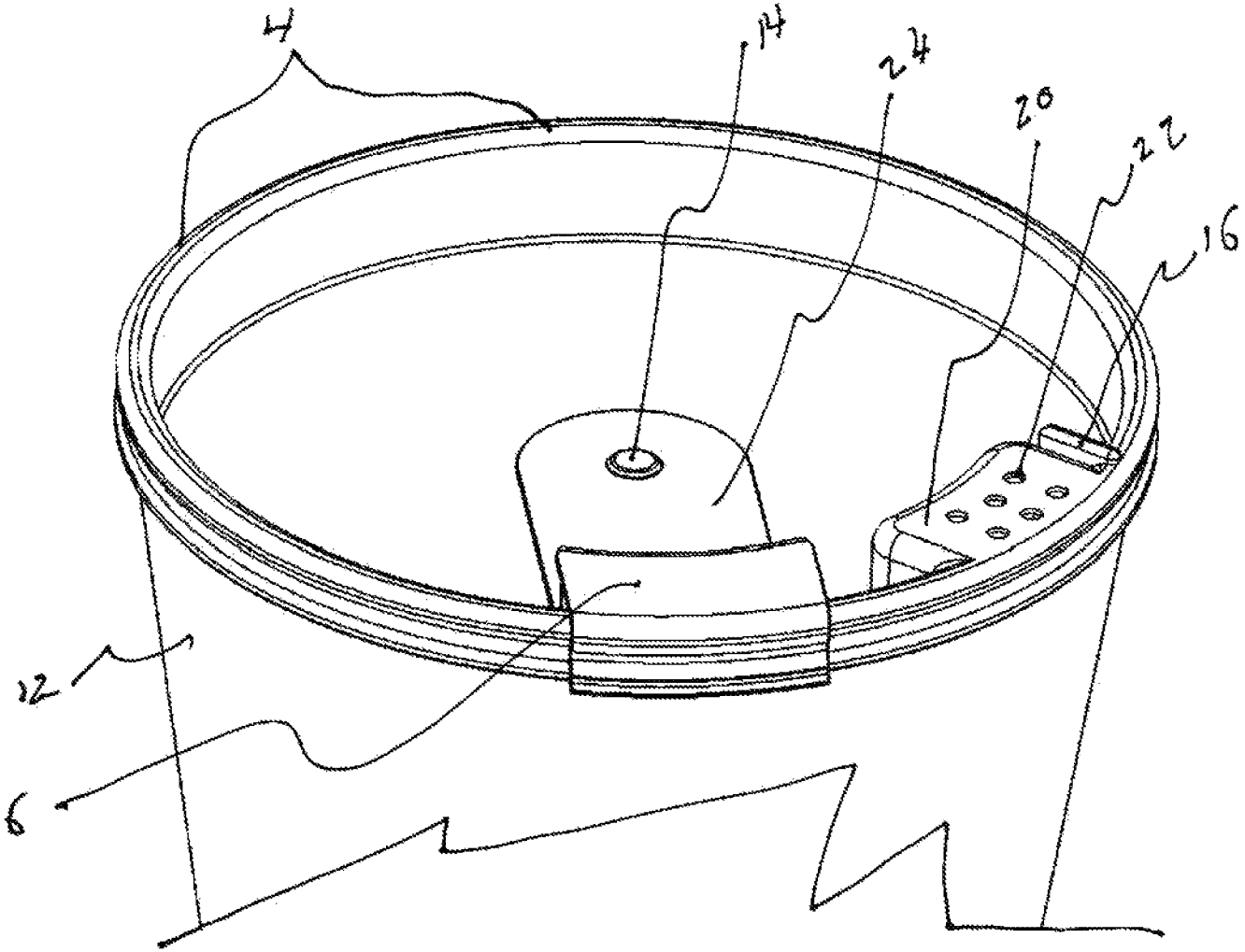
FIG. 3 is a partial perspective view of the invention with the aperture closure member swung to the open position.

A flat surface 6 of the aperture cover 2 covers a flat aperture surface 20 that includes a plurality of small holes 22 as shown in FIG. 3.

Figure 2:
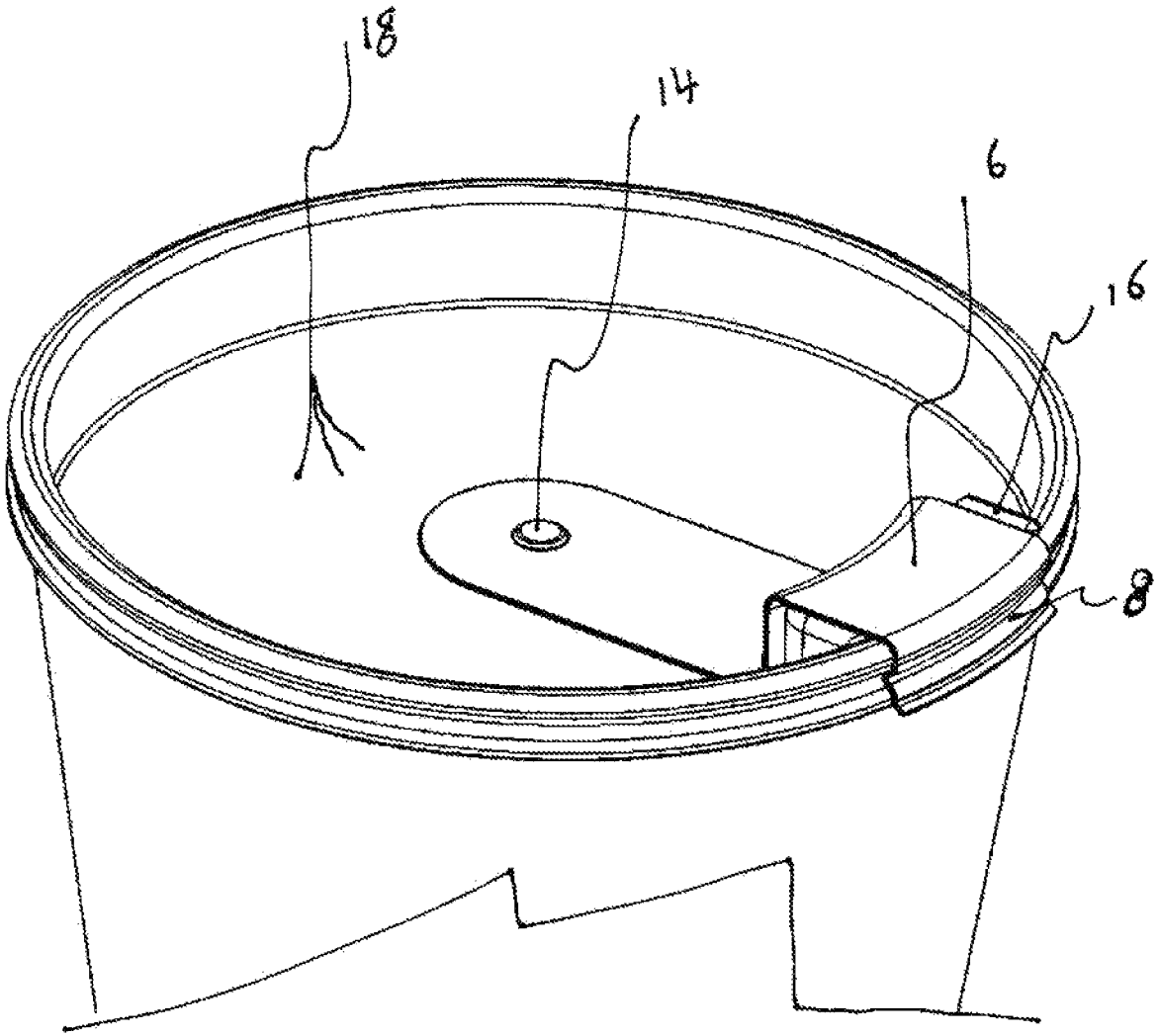
FIG. 2 is a partial perspective view of the invention showing a closer view of the aperture closure member in place on the primary lid.

FIG. 2 is a partial perspective view of the aperture cover 2 in the closed position. The aperture cover 6 includes a front rim portion 8 that snaps into the concave portion of the lid 4 side, holding the aperture cover 6 snuggly against the flat aperture surface 20 thereby reducing the chance of spillage during use. The stop member 16 on the right side of the aperture surface 20 makes it so that when the user slides the flat surface 6 of the aperture cover 2 to the right, it will automatically return to the fully closed position without the user having to visually see the activity taking place. In this way, the user can take part in normal activity and slide the aperture cover 2 to the left to drink, and to the right to cover the small holes 22 without losing eye contact with other people in a group. The result is that the user can maintain protection of the aperture portion of the lid with minimal effort thereby reducing the chance that an individual can insert a pill or powder or liquid into the aperture holes 22 without the user's knowledge. Because the holes 22 are approximately one eighth of an inch in diameter they provide another layer of protection from the unwanted insertion of a pill, powder or liquid. Yet the holes 22 are large enough to allow an easy exit for the beverage contained within cup 12. The central surface 18 of the lid 100 is depressed approximately one half of one inch to allow room for the user's nose when the user is drinking from the cup 12.

FIG. 3 is a partial perspective view of the aperture cover 2 in the open position, allowing the user full access to holes 22. The entire lid 4 and aperture cover 2 are thermo-formed from a sheet of food grade plastic.

For a transparent cover, PET plastic is recommended. If transparency is not required, a lid made from opaque polystyrene is recommended.

FIG. 4 is an exploded view of the invention 100. Lid 4 can snap onto the perimeter of cup 12 in a standard way aperture cover 2 is snapped onto central post 14 via aperture 15 and also snapped onto the front of the lid 4 via side panel 8.

The above description and accompanying drawings show a unique lid for a disposable cup that helps prevent unwanted material from being deposited into a drinking cup while at the same time allowing a user to safely drink from the cup when so desired.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A drink protector lid comprising:

a reclosable thermo-formed plastic circular lid capable of being snapped onto a disposable cup rim comprising:

i. a circular central surface surrounded by a circumferential rim, the circumferential rim comprising an inner skirt surface, an outer skirt surface, and a top surface, wherein the outer skirt surface, the inner skirt surface and the top rim surface snappably straddle the disposable cup rim;

ii. the circular central surface comprising a drink disposing aperture surface, the drink dispensing aperture surface having an essentially curved trapezoid shape including straight equal length short sides, a short arc, and a long arc, the long arc of the aperture surface disposed along the rim inner skirt surface;

iii. the aperture surface comprising a plurality of small apertures allowing liquid in the disposable cup to pass through but small enough to discourage insertion of foreign matter, the aperture surface further including a raised stop portion disposed along one of the aperture surface short sides;

iv. the circular central surface disposed below the disposable cup rim comprising a center, further comprising an upwardly mushroom shaped post disposed in the center of the circular central surface;

v. a rotatably slidable aperture surface cover comprising a front rim portion end snappably straddling the circumferential rim top surface and the circumferential rim outer skirt surface;

vi. the aperture surface cover further including a radially disposed extension tab comprising an aperture in a circular die cut end portion capable of forcibly snapping over the upwardly mushroom shaped post enabling the slidable cover to snugly slide around the cover rim and to snugly close the apertures in the aperture surface when rotated to cover the aperture surface; and vi. the rotatable slidable cover being stopped from rotating past the aperture surface by the raised stop portion disposed along one of the aperture surface sides essentially closing the apertures when rotated over the aperture surface while being free to move in opposite direction uncovering the apertures in the aperture surface.

* * * * *